US005831650A

United States Patent [19]

Reinten

[11] Patent Number: 5,831,650

[45] Date of Patent: Nov. 3, 1998

[54] INK-JET PRINTHEAD

[75] Inventor: Hans Reinten, Velden, Netherlands

[73] Assignee: Océ-Nederland B. V., Ma Venlo, Netherlands

[21] Appl. No.: 675,314

[22] Filed: Jul. 3, 1996

[30] Foreign Application Priority Data

Jul. 3, 1995 [EP] European Pat. Off. ..... 95201803

[51] Int. Cl.[6] ..... B41J 2/135

[52] U.S. Cl. ..... 347/68; 347/46

[58] Field of Search ..... 347/46, 68, 69, 347/70, 71, 72

[56] References Cited

U.S. PATENT DOCUMENTS

| | | | |
|---|---|---|---|
| 4,788,557 | 11/1988 | Howkins | 347/68 |
| 4,812,859 | 3/1989 | Chan et al. | 347/63 |
| 4,887,100 | 12/1989 | Michaelis et al. . | |
| 5,087,930 | 2/1992 | Roy et al. | 347/85 |
| 5,266,965 | 11/1993 | Komai et al. . | |

FOREIGN PATENT DOCUMENTS

| | | |
|---|---|---|
| 0063921 | 3/1982 | European Pat. Off. . |
| 402172 | 12/1990 | European Pat. Off. . |
| 60-90770 | 5/1985 | Japan . |
| 92 06848 | 4/1992 | WIPO . |

*Primary Examiner*—Stuart N. Hecker

[57] ABSTRACT

An ink-jet printhead includes a plurality of nozzles and ink channels arranged side by side, each nozzle being connected to an ink reservoir via its associated ink channel, and a plurality of electromechanical transducers, respectively, associated with each ink channel for pressurizing the ink liquid therein, so that an ink droplet is expelled from the nozzle. An active member is provided for compensating for the effect of the reaction force of each transducer by energizing at least one other transducer.

19 Claims, 3 Drawing Sheets

INK-JET PRINTHEAD

BACKGROUND OF THE INVENTION

Field Of The Invention

The invention relates to an ink-jet printhead comprising a plurality of nozzles and ink channels arranged side by side, each nozzle being connected to an ink reservoir via its associated ink channel, and a plurality of electromechanical transducers respectively associated with each ink channel for pressurizing the ink liquid therein so that an ink droplet is expelled from the nozzle.

Description Of Background Art

Printheads of this type are known for example from EP-B1-0 402 172 and from JP-A-60-90770. The ink channels are formed by grooves in the top surface of a substrate which are closed by a cover plate. The electromechanical transducers are disposed on top of the cover plate and are formed by a piezoelectric body with a comb-like cross-sectional shape. The piezoelectric body has a continuous top layer bridging the plurality of ink channels and a number of finger portions which project from the top layer toward the individual ink channels. The end face of each channel is held in engagement with the cover plate and is provided with an electrode which cooperates with at least one other electrode which is embedded in the finger or is provided on the top layer of the piezoelectric body.

When a voltage pulse is applied to the electrodes of an individual finger in response to a drop demand signal, this finger is caused to contract and expand in the vertical direction, i.e. in the direction in parallel with the electric field between the electrodes, due to the piezoelectric effect. Thus, the finger acts like a piston which deflects the portion of the cover plate delimiting the associated ink channel, so that the volume of the ink channel is first increased to suck-in ink liquid from the ink reservoir and is then reduced, so that an acoustic pressure wave is generated in the ink channel. This pressure wave propagates to the nozzle so that in ink droplet is expelled from the nozzle.

In a conventional printhead of this type, the top layer of the piezoelectric body must be backed-up by a support structure with sufficient rigidity and/or mass of inertia to absorb the reaction forces created by the contraction and expansion strokes of the individual fingers. The support structure satisfying these requirements leads to increased manufacturing costs and to a high weight and comparatively large outer dimensions of the printhead.

In addition, even if a very stiff and massive support structure is employed, it cannot be avoided that a portion of the acoustic energy created by an individual finger is transmitted through the support structure to the neighbouring fingers, so that "cross-talk" between the individual channels is observed. This means that the performance of an individual unit, comprising a nozzle and its associated ink channel and piezoelectric finger, is influenced by the status of its neighbouring units, so that the quality of the printed image may be degraded. This problem becomes particularly virulent if the pitch of the nozzles in the printhead is reduced in order to enable high-resolution printing.

SUMMARY AND OBJECTS OF THE INVENTION

It is accordingly an object of the invention to provide an ink-jet printhead which is able to simplify or completely omit the support structure for the transducers and to eliminate or mitigate cross-talk among the individual nozzle units.

According to the invention, this object is achieved with an ink-jet printhead which includes an active means for compensating for the effect of the reaction force of each transducer by energizing at least one other transducer.

Thus, according to the general concept of the invention, cross-talk among the different channels is actively compensated and/or the reaction force of one transducer which has been energized is actively counterbalanced by appropriately energizing one or more of the other transducers.

In one embodiment, the active means comprise control means for supplying a compensation signal to individual transducers depending on whether or not their respective neighbours are energized. If, for example, three immediately adjacent nozzle units are activated simultaneously, the transducer of the central unit will be subject to reaction forces from both its neighbours, and these reaction forces tend to reduce the stroke efficiency of the central unit. In order to obtain droplets of the same size from all three nozzles, a compensation signal is supplied to the central unit so that the amplitude of the voltage pulse applied to its transducer is increased. On the other hand, if only the central unit and its right neighbour are activated and the left neighbour is kept inactive, then it is possible to supply a compensation signal in the form of a negative pulse to the transducer of the inactive unit. As a result, the reaction forces of the left and right neighbours will largely cancel each other at the location of the central unit. Of course, the negative pulse applied to the left unit must in this case be kept at a sufficiently low level which does not lead to the generation of a droplet.

It will be understood that the compensation signal for an individual unit may be made dependent not only on the status of its immediate neighbours but also on the status of its indirect neighbours of a higher order. In general, depending on the number of neighbours that is taken into account, a certain number exists of possible configurations of active and inactive units, and for each possible configuration, an appropriate compensation signal will be selected by means of a table look-up method or the like. The appropriate values of the compensation signal will depend on the mechanical properties of the printhead structure and can be determined beforehand by experiment or by simulation calculations.

In a more specific embodiment, the totality of the nozzle units of the printhead is divided into two or more groups which are activated at different timings. For example, when the nozzle units are numbered sequentially, a first group may consist of all odd-numbered nozzle units and a second group may consist of all even-numbered nozzle units. Then, the units of the first and second groups will be enabled and disabled alternatingly. Within the enabled group, of course, only those units will be activated for which a drop demand signal is present. If, at a given instant, a specific nozzle, e.g. no. 2, is activated, it is assured that its immediate neighbours, i.e. the nozzle units no. 1 and 3, cannot be activated at the same time. It is therefore possible to energize the transducers of the units no. 1 and 3 with a compensation signal which does not lead to the generation of droplets but just counterbalances the reaction force of the transducer of unit no. 2 from which a droplet is to be expelled. Thus, irrespective of the image information to be printed, it is possible to eliminate cross-talk among the different channels simply by appropriately setting the compensation voltages to be applied to the nozzle units of the disabled group.

The level of the compensation voltage for an individual transducer of the inactive group depends only on the active or inactive status of its two immediate neighbours. It is clear that, with such a system, the support structure for backing the transducers against the reaction forces may be made rather weak or may be omitted completely. If, in the last mentioned embodiment, all the nozzles of the printhead are aligned on a single line and the printhead is continuously moved relative to the printing paper in a direction orthogonal to this line, then the dots or pixels printed with the even-numbered nozzle units will be offset from those printed with the odd-numbered nozzle units. As a consequence, the dot pattern of the printed image will generally be rhombic. By appropriately setting the timings at which the first and second groups of nozzle units are activated, it is possible to obtain a square dot matrix with the main directions of the dot matrix being inclined at an angle of 45° relative to the line defined by the nozzles of the printhead. In this case, the resolution of the printed image is smaller than the pitch of the nozzles by a factor of $\sqrt{2}$.

However, it is possible to obtain a resolution equivalent to the pitch of the nozzles if the configuration of the printhead is modified such that the nozzles of the first and second groups are offset in the subscanning direction, i.e. in the direction of relative movement of the printhead and the printing paper.

In a particularly preferred embodiment of the invention the active means comprise auxiliary transducers which are provided in addition to the piston-type transducers facing the ink channels. These auxiliary transducers may for example be arranged as active links between the piston-type transducers and may be energized to counterbalance differential reaction forces of the piston-type transducers. The auxiliary transducers may be formed by piezoelectric elements with any geometrical shape, polarization and electrode configuration suitable for causing displacements of the associated piston-type transducers relative to its neighbours or relative to the substrate. In a particularly useful design the piston-type transducers and the auxiliary transducers are formed by a comb structure in which the individual fingers form the piston-type transducers and a continuous layer interconnecting the fingers forms the auxiliary transducers. In this case the piezoelectric effect may be utilized to cause shear stresses in the continuous layer forming the auxiliary transducers.

In another embodiment of the invention each nozzle unit is provided with a pair of piston-type transducers disposed on opposite sides of the ink channel. In this case, the two transducers of each pair are energized simultneously, and they cooperate to pressurize the ink volume in the channel from both sides. Thus, each transducer forms active means for counterbalancing the reaction force of the opposing transducer. To this end, the respective ends of the transducers remote from the ink channel may be rigidly interconnected by web members intervening between the adjacent nozzle units. Alternatively, each transducer of one pair may be rigidly connected to the corresponding transducers of the neighbouring nozzle units, and the nozzle units may be divided into several groups which are energized at different timings as in the previously described embodiment. In this case, the transducers disposed on the same side of the ink channels may also be interconnected via auxiliary transducers serving as active links.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

Figure 1:
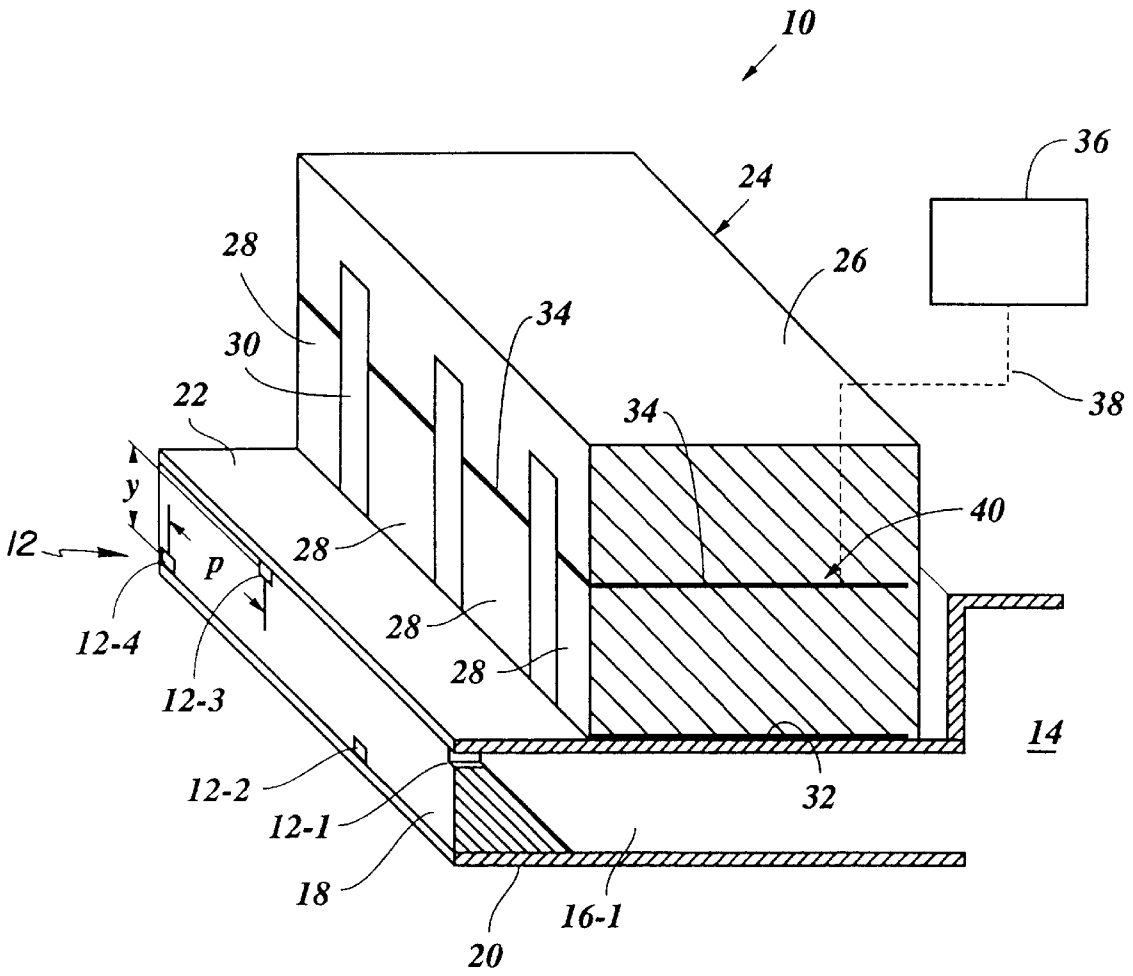
FIG. 1 is a cut-away perspective view of an ink-jet printhead according to one embodiment of the invention.

As is shown in FIG. 1, a printhead 10 comprises a plurality of nozzles 12-1, 12-2, 12-3, 12-4, these nozzles will be commonly designated by the reference numeral 12. Each nozzle is fluidly connected to an ink reservoir 14 via an ink channel 16. The ink channels are formed by grooves which are arranged side by side in a common substrate 18. The substrate 18 is sandwiched between a bottom plate 20 and a cover plate 22. A comb-shaped piezoelectric body 24 is disposed on top of the cover plate 22. The piezoelectric body 24 has a continuous top layer 26 and a plurality of fingers 28 which project downwardly from the top layer so that the bottom face of each finger engages the cover plate 22 in a area immediately above a corresponding one of the ink channels 16.

The gaps between the individual fingers are filled with a resilient filler material 30 which may be formed integrally with the cover plate 22. A ground electrode 32 is disposed at the bottom face of each finger 28. An energizing electrode 34 is embedded in each finger 28 so that it extends in parallel with the corresponding ground electrode 32 and is separated therefrom by a predetermined distance.

Each individual energizing electrode 34 is connected to a control unit 36 via a signal line 38, as is symbolically shown in the drawing. Thus, in each finger 28, the energizing electrode 34, the associated ground electrode 32 and the piezoelectric material intervening therebetween form a piston-type piezoelectric transducer 40 which can be caused to expand and contract in the vertical direction by supplying an appropriate voltage to the electrode 34. Since the bottom face of each finger 28 is bonded to the cover plate 22, the contractions and expansions of the transducer 40 cause a deflection of the corresponding portion of the cover plate 22, so that the volume of the associated ink channel is varied. The ink reservoir 14 and the ink channels 16 are filled with liquid ink, and when the piezoelectric transducer 40 is activated, an acoustic pressure wave is generated in the ink liquid. This acoustic pressure wave propagates toward the associated nozzle, e.g. 12-1. Since the ink channel is tapered toward the nozzle, the pressure wave converges on the nozzle and causes the creation of an ink droplet which is expelled from the nozzle to be deposited at an appropriate position on a printing paper (not shown) which is disposed in front of the printhead.

In detail, the printhead 10 is moved relative to the printing paper in the vertical direction in FIG. 1, and the transducer 40 is energized at an appropriate timing in accordance with an image signal supplied to the control unit 36, so that the ink droplet is placed at the correct position on the paper. In order to create a pressure wave in the ink channel 16-1 with high energy efficiency, a voltage pulse is applied to the electrode 34 such that the transducer 40 contracts at the leading edge of the pulse and expands at the trailing edge of the pulse. As a result, the transducer 40 first performs a suction stroke so that ink liquid is sucked-in from the reservoir 14. More precisely, the suction stroke suddenly creates a negative pressure in the area below the transducer 40, so that a negative pressure wave propagates in the ink channel 16 in both directions. When the wave front of the negative pressure wave travelling towards the ink reservoir 14 reaches the open end of the ink channel 16, it is reflected with phase reversal and travels back as a positive pressure wave in the direction of the nozzle 12. The duration of the voltage pulse is such that the compression stroke occurs at the very moment when the wave front of this positive pressure wave reaches the left end of the transducer 40 in FIG. 1, i.e. the end which is closer to the nozzle 12. As a consequence, the additional positive pressure wave created by the expansion stroke of the transducer shows positive interference with the pressure wave which had been created by the suction stroke. In this way, the mechanical energy of the transducer 40 is transformed into acoustic energy with high efficiency.

As is shown in FIG. 1, the nozzles 12 are alternatingly arranged in two parallel lines which extend at right angles to the direction of relative movement of the printhead and the printing paper, so that the odd-numbered nozzles 12-1, 12-3 are vertically offset from the even-numbered nozzles 12-2, 12-4 by an amount y. This can be achieved for example by cutting the ink channels 16 alternatingly into the top surface and the bottom surface of the substrate. Alternatively, all ink channels may be cut into the substrate from the top surface, and the even-numbered nozzles 12-2, 12-4 may be delimited by deeper grooves in the substrate 18 and by projections on the bottom surface of the cover plate 22 which block the top-parts of these grooves.

The distance or the pitch p between adjacent nozzles corresponds to the resolution of the printhead 10 in the direction of the printed image lines. However, due to the offset y between the even-numbered and odd-numbered nozzles, the energizing pulses must be supplied to the even-numbered nozzles on the one hand and the odd-numbered nozzles on the other hand at different timings in order to obtain a continuous print line. The reason for this design will become evident as the description proceeds.

Figure 2:
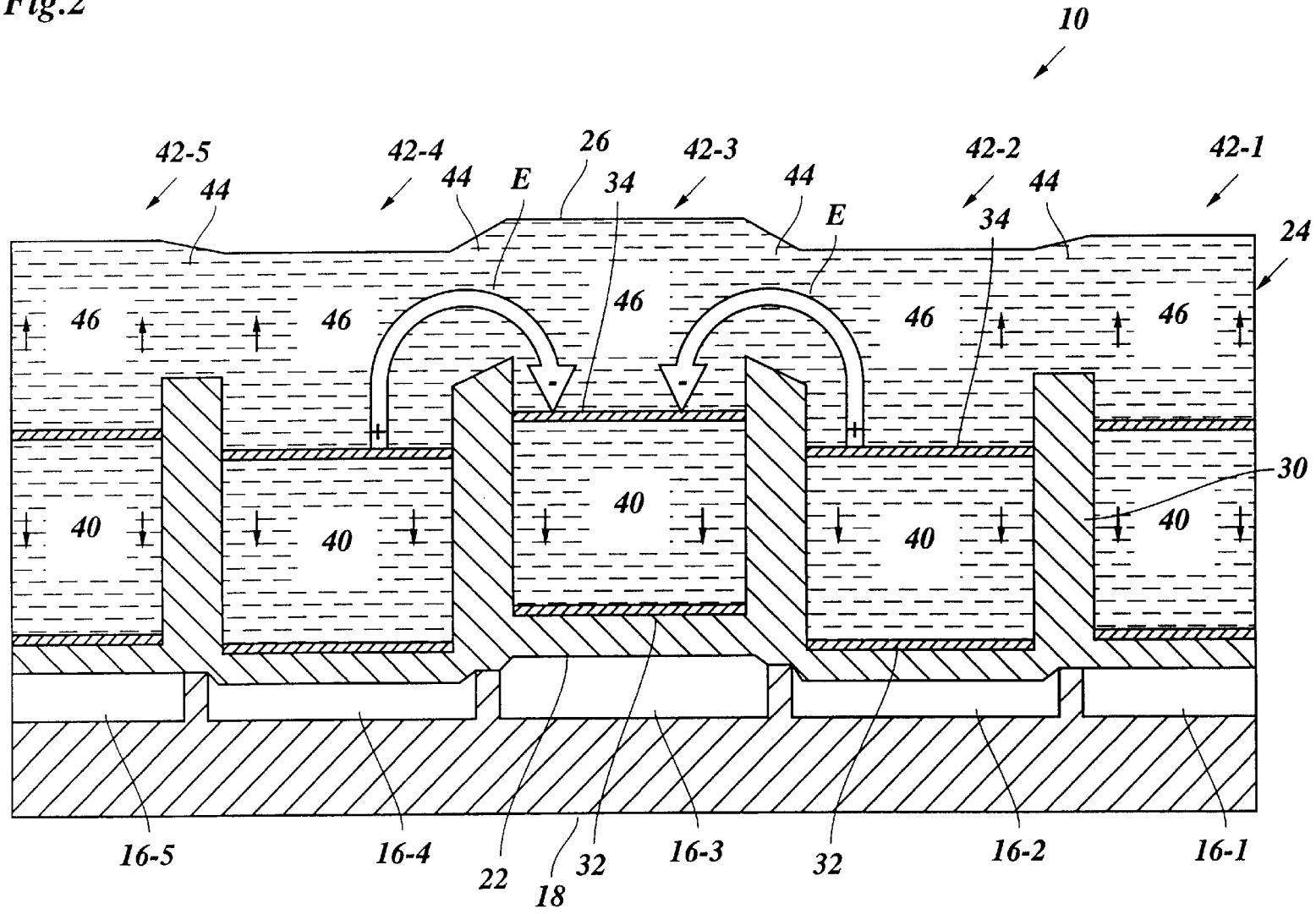
FIG. 2 is a schematic cross-sectional view of a number of nozzle units of the printhead shown in FIG. 1.

An assembly comprising one individual nozzle with its associated ink channel and transducer will be termed "nozzle unit" or briefly "unit" hereinafter. FIG. 2 is a cross-sectional view showing five nozzle units 42-1 to 42-5 of the printhead 10, the nozzle units will be commonly designated by reference numeral 42. It is observed that the piston-type transducers 40 of the nozzle units are mechanically interconnected by the top layer 26 of the piezoelectric body. Thus, if for example the transducer 40 of the unit 42-3 performs an expansion stroke against the elastic forces of the bottom plate 22 and the liquid in the ink channel 16-3, it will tend to lift the top layer 26 locally. If no countermeasures were taken, the transducers 40 of the neighbouring nozzle units, mainly but not exclusively the immediate neighbours 42-2 and 42-4, would be slightly lifted and the pressure of the ink liquid in the corresponding ink channels would be reduced. Conversely, if the transducer of the unit 42-3 performs a suction stroke, as is shown in the drawing, the top layer 26 would be flexed downward and the ink in the ink channels 16-2 and 16-4 would be slightly pressurized. These undesired cross-talk effects would make it difficult to obtain a stable droplet size from the active nozzle units. In addition, a part of the mechanical energy of the active transducer of the unit 42-3 would be transferred to the neighbouring units, thereby reducing the efficiency with which a desired acoustic pressure wave in the ink channel 16-3 can be generated. These effects could be mitigated to some extent by supporting the top ends of the transducers 40 with a massive and rigid backing plate. However, according to the present invention, a different approach is made to eliminate these phenomena.

As was mentioned above, the odd-numbered nozzle units 42-1, 42-3 and 42-5 on the one hand and the even-numbered nozzle units 42-2 and 42-4 on the other hand are energized in accordance with the respective image signals at different timings. Thus, when the unit 42-3 is active, the neighbouring units 42-2 and 42-4 will assuredly be inactive, and vice versa. As a consequence, when the top layer 26 is subject to reaction forces from the transducers 40 of the active units 42-1, 42-3 and 42-5, the transducers of the inactive units 42-2 and 42-4 can be used to counterbalance the reaction forces without generating droplets in these units itself.

The polarizations of the various portions of the piezoelectric body are indicated by solid black arrows in FIG. 2. It is observed that the transducers 40 are uniformly polarized in one vertical direction (downward) whereas the top layer 26 is uniformly polarized in the opposite vertical direction (upward). In Fig, 2, the printhead 10 is shown in a state in which the nozzle units 42-1 and 42-5 are inactive whereas the central nozzle unit 42-3 has just performed a suction stroke in order to prepare for the generation of a droplet. Accordingly, a negative voltage is applied to the energizing electrode 34 of the unit 42-3, so that the piezoelectric material of the transducer 40 is subject to an electric field between the electrodes 34 and 32. Since this electric field has the opposite direction as the polarization of the piezoelectric material, the transducer 40 is in its contracted state. As a consequence, the top layer 26 above the unit 42-3 is subject to a downwardly directed reaction force.

Simultaneously, a comparatively small, positive voltage is applied to the electrodes 34 of the units 42-2 and 42-4, so that their transducers 40 are slightly expanded. The portion of the top layer 26 above the units 42-2 and 42-4 is therefore subject to an upwardly directed reaction force which partly compensates for the reaction force of the central unit 42-3.

In addition, since opposite voltages are applied to the electrodes 34 of the unit 42-3 on the one hand and the units 42-2 and 42-4 on the other hand, an electric field E is established which penetrates through the top layer 26 of the piezoelectric body. In the portions of the top layer 26 bridging the individual nozzle units, this electric field E has a large horizontal component and is directed substantially perpendicular to the direction of polarization in this top layer. This causes a shear stress in the top layer 26 because the piezoelectric material has the tendency to align its preferential axis with the axis of the electric field E. As a result, the top layer 26 is deformed in a shear mode, as is exaggeratedly shown in the drawing. This shear-type deformation of the top layer 26 has the tendency to lift the portion of the top layer above the unit 42-3 and to depress the portions above the units 42-2 and 42-4. Thus, this shear-type deformation greatly contributes to counterbalancing the reaction force of the transducer 40 of the unit 42-3. The portions of the top layer 26 bridging the individual nozzle units, in combination with the electrodes 34 of these units, can therefore be considered as auxiliary transducers 44 which serve as active backing means for absorbing the reaction forces of the piston-type transducers 40.

It goes without saying that these auxiliary transducers 44 will also be effective when the unit 42-3 performs its expansion stroke with a positive voltage being applied to its electrode 34 and a small negative voltage applied to the electrodes 34 of the units 42-2 and 42-4. The auxiliary transducers 44 would also be effective, though to a smaller extent, if the electrodes 34 of the units 42-2 and 42-4 were not energized but were kept at ground potential. In a situation where the unit 42-1 for example is required to generate a droplet simultaneously with the unit 42-3, an electric field would also be created between the electrodes 34 of the units 42-1 and 42-2 and the transducer 44 between these units would be effective to absorb the reaction force of the unit 42-1. Of course, it is advisable to slightly increase the voltage applied to the electrode 34 of the unit 42-2 dependent on whether only one or both of its neighbours are energized.

By utilizing the effect of the auxiliary transducers 44 and/or the counterbalancing effect of the expansions and contractions of the transducers 40 of the inactive units 42-2, 42-4 oppositely to the expansions and contractions in the active unit 42-3, it is possible to eliminate the cross-talk effect completely and to stabilize the top layer 26 without any need for a rigid backing plate. Of course, such a backing plate may additionally be provided, if desired.

In particular when the top layer 26 is arranged to form the auxiliary transducers 44, the compensation voltages which have to be applied to the electrodes 34 of the inactive units, 42-2 and 42-4 in this example, in order to eliminate the cross-talk effect can be kept so small that no droplets will be generated by these units, 42-2, 42-4, and the acoustic pressure waves generated in their ink channels, 16-2, 16-4, will largely be attenuated before these units become active. In this respect, it is important to note that in the inactive units 42-2, 42-4 which are energized only for compensation purposes, the transducers are first expanded and then contracted. This helps to keep the excitation levels of the acoustic pressure waves below the threshold at which droplets are generated.

When, in the example shown in FIG. 2, the unit 42-3 and other odd-numbered nozzle units have printed dots on the printing paper and the printhead has been moved relative to the printing paper over a distance corresponding to the offset y, the even-numbered units 42-2, 42-4 will be activated to insert the missing image dots in the current printing line in accordance with the image information. At this instant, the odd-numbered units will be used for compensation purposes.

Returning to the situation shown in FIG. 2, it will be noted that the electric field E established between the neighbouring electrodes 34 has a large vertical component in the region of the unit 42-3. This component of the electric field has the opposite direction as the polarization of the top layer 26 and therefore causes a vertical contraction of the corresponding portion of the top layer 26, thus assisting the contraction of the transducer 40. Similarly, the portions of the top layer 26 in the units 42-2, 42-4 are caused to expand and to enhance the effect of the transducers 40 of these units. Likewise, when the polarities are inverted so that the unit 42-3 performs an expansion stroke and the units 42-2 and 42-4 perform contraction strokes, these strokes will also be enhanced by corresponding expansions and contractions of the respective portions of the top layer 26. Thus, the portions of the top layer immediately above the electrodes 34 function as secondary piston-type transducers 46 which assist the primary piston-type transducers 40. This effect is particularly advantageous because it increases the efficiency with which the electric energy applied to the electrodes 34 can be transformed into acoustic energy in the respective ink channels.

In general, in order to achieve an optimal transformation of mechanical energy of the piezoelectric elements into acoustic energy in the ink channels, the ratio between the effective thickness of the piezoelectric element and the height of the ink channel should be of the same order as the ratio between the elastic modules of the piezoelectric material and the ink liquid. However, the height of the ink channels 16 cannot be reduced beyond a certain limit because this would lead to higher reflection losses at the nozzles 12, so that only a smaller portion of the acoustic energy would be available for the creation and acceleration of the ink droplets. For these reasons, it would be desirable to increase the thickness of the transducers 40. Then, however, the distance between the electrodes 32 and 43 would become larger and a higher voltage would have to be applied to the electrodes 34 in order to obtain the same field strength. In the shown embodiment, the secondary transducers 46 function to increase the effective thickness of the piezoelectric elements without any need for increasing the voltage applied to the electrodes 34. This effect can be enhanced further if an additional ground electrode (not shown) is provided on the top surface of the top layer 26.

In this example the cover plate 22 and the filler material 30 forms an integral member but it is understood that the cover plate 22 can also be made as a separate plate and that filler material 30 can be omitted.

Figure 3:
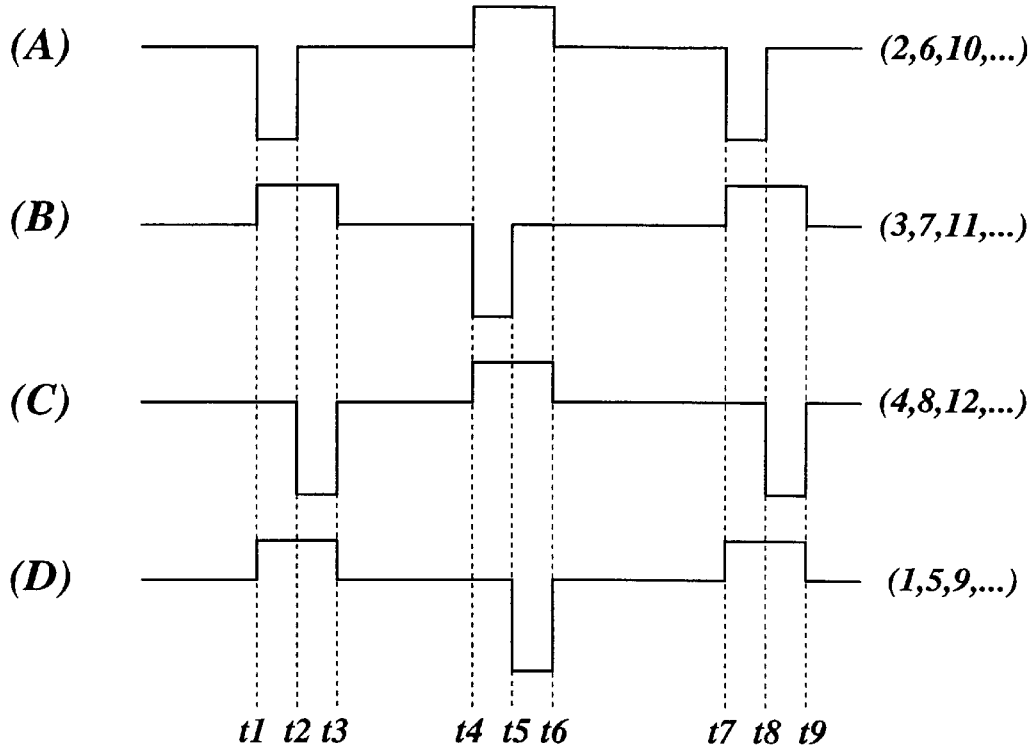
FIG. 3 is a time chart of signals to be supplied to various electromechanical transducers in the printhead shown in FIG. 1.

A preferred mode of operation of the printhead 10 described above will now be explained by reference to FIG. 3. The curves (A)–(D) in FIG. 3 represent the voltage signals applied to four successive nozzle units, e.g. 42-2, 42-4 and 42-5. The printhead is assumed to have a large number of nozzle units, and the pattern of signals shown in FIG. 3 is repeated for each group of four successive nozzle units, so that, for example, the signal represented by the curve (D) will not only be applied to the nozzle unit 42-5 but also to the nozzle unit 42-1.

It is further assumed in FIG. 3 that a solid black area is printed on the printing paper, so that each nozzle unit is active to print a dot in each printing line. The even-numbered nozzle units, curves A and C, are active in the time intervals t1–t3 and t7–t9, and the odd-numbered nozzle units, curves B and D, are active in the time interval t4–t6.

At the time t1, a negative voltage is applied to the electrode 34 of the nozzle unit 42-2 to cause the transducers 40, 46 of these units to contract and to perform a suction stroke (A). Simultaneously, a positive compensation voltage is applied to the units 42-3 and 42-1 which are the left and right neighbours of the unit 42-2, curves B and D. As a result, the transducers 40, 46 of the units 42-3 and 42-1 perform a slight expansion stroke, and the auxiliary transducers 44 intervening between these units and the unit 42-2 are deformed in the shear-mode. The amplitude of the positive compensation voltages is just sufficient to counterbalance the reaction force of the transducers 40, 46 of the unit 42-2, but is not large enough to generate droplets in the units 42-1 and 42-3. It should be noted that the unit 42-4 (C) is not active at this instant, which has the advantage that the unit 42-3 needs to compensate only the reaction force of the unit 42-2 but not that of the unit 42-4.

At the time t2 the unit 42-2 performs its expansion stroke in order to create a droplet. Simultaneously, its indirect neighbour, the even-numbered unit 42-4, and a unit 42-0 as the case may be, performs its suction stroke. Thus, the reaction forces of the expanding unit 42-2 and the contracting unit 42-4 cancel each other at the position of the unit 42-3 intervening therebetween. The compensation signals for the odd-numbered units 42-3 and 42-1 are therefore not altered at this instance, curves B and D. However, in the time interval t2–t3, the voltage difference between the electrodes 34 of the units 42-2 and 42-3 is much smaller than the voltage difference between the electrodes of the units 42-3 and 42-4. As a consequence, the auxiliary transducer 44 between the units 42-2 and 42-3 becomes less effective and the auxiliary transducer 44 between the units 42-3 and 42-4 becomes more effective. These effects assist both the expansion stroke of the unit 42-2 and the suction stroke of the unit 42-4.

At the time t3 the unit 42-4 performs it expansion stroke, and the reaction force thereof is compensated by its direct neighbours 42-1 and 42-3 which return to zero potential.

In the time from t4 to t6 the above-described procedure is repeated with the rolls of the even-numbered units and odd-numbered units being interchanged. The procedure in the time between t7 and t9 is again identical to that between the times t1 and t3.

It will be noted that the even-numbered unit 42-2 creates a droplet at the time t2 whereas the droplet generation in the next even-numbered unit 42-4, at t3, is somewhat delayed. When the printhead is moved continuously relative to the printing paper, this may cause a slight offset of the printed dots which, however, will normally not be perceptible to the human eye. If desired, this time delay can also be compensated by an appropriate position offset of the corresponding nozzles in the printhead.

It will further be observed that the pulse width of the positive compensation pulses is twice the pulse width of the energizing pulses applied to the active units. As has been mentioned before, the pulse width of the energizing pulses, e.g. from t1 to t2, is adapted to the geometric configuration of the printhead such that the acoustic wave in the ink channel shows resonance or constructive interference, in order to provide a high energy for the creation of the droplet. Since the compensation pulses are twice as long, they will under these conditions cause destructive interference in the ink channel, so that the creation of droplets is desirably suppressed.

In practice, it depends of course on the image information to be printed whether or not an energizing pulse is applied to a given nozzle unit in a given cycle. This means that in the signal pattern discussed above for illustrative purposes, some of the negative energizing pulses may be missing. In this case, the amplitude and/or duration of the compensation pulses may be modified in accordance with the image information. For example, if the unit 42-4 is not activated between t2 and t3, i.e. the first energizing pulse in the signal (C) is missing, then the duration of the compensation pulse in the signal (B) may be reduced to ½, so that the potential of the electrode in the unit 42-3 is returned to zero already at the time t2.

The signals to be applied to the electrodes 34 of the individual nozzle units are generated in the control unit 36, FIG. 1, in response to the image information to be printed. The corresponding software and/or hardware implementation of the control unit 36 is straightforward for a person skilled in the art.

Figure 4:
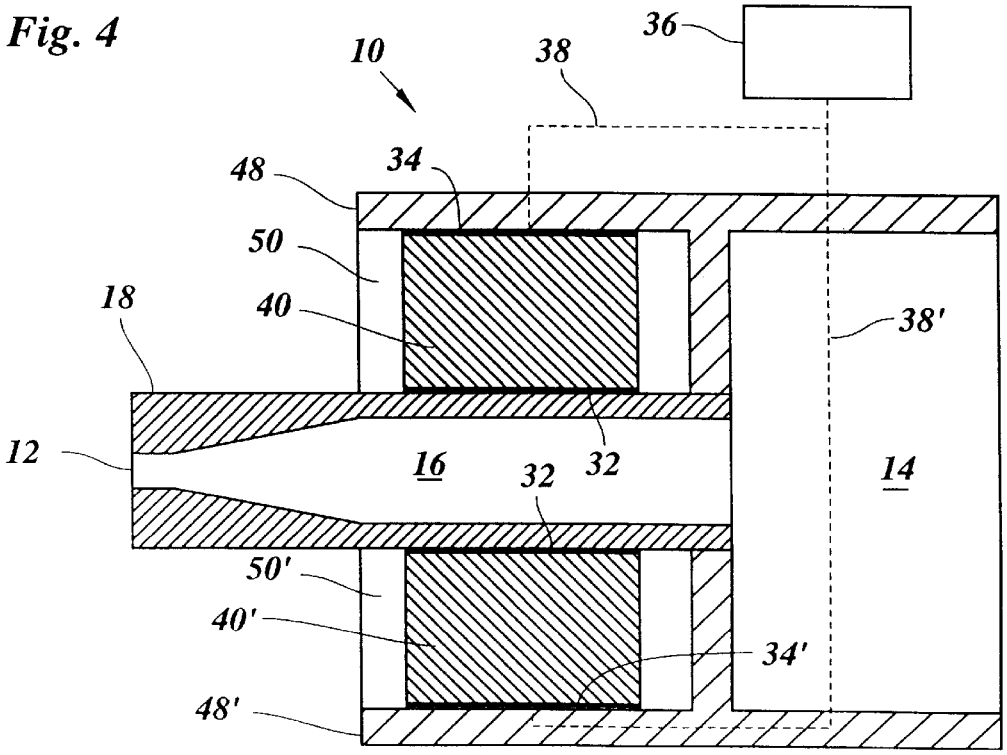
FIG. 4 is a schematic longitudinal cross-sectional view of a printhead according to another embodiment of the invention.

FIG. 4 shows a printhead 10 according to another embodiment. The nozzles 12 of this printhead are aligned on a single line, and the whole printhead has a symmetric configuration with respect to a plane defined by the ink channels 16. Thus, a pair of piston-type piezoelectric transducers 40, 40' are opposed to one another across the substrate 18 above and below each ink channel 16. The transducers 40, 40' and the substrate 18 are held together by two symmetric housing parts 48, 48' which have rigid web portions 50, 50' intervening between the transducers of the different nozzle units and fixedly connected to the substrate 18, e.g. by bonding. Thus, the housing parts 48, 48' and the substrate 18 form an integral member which has some tensile strength in the vertical direction, i.e. in the direction in which the transducers 40, 40' perform their contraction and expansion strokes. The top surface of the transducer 40 and the bottom surface of the transducer 40' are fixedly connected to the housing part 48 and 48', respectively, via the energizing electrode 34 and 34', respectively. The parts of the substrate 18 defining the upper and lower walls of the ink channel 16 are fixedly connected to the transducers 40 and 40', respectively, via the ground electrodes 32.

The control unit 36 is arranged to energize both transducers 40 and 40' with the same voltage via respective leads 38 and 38'. Thus, the transducers 40, 40' perform synchronous contraction and expansion strokes. During the contraction strokes, the comparatively thin, flexible wall portions defining the ink channel 16 are drawn apart, and the reaction forces of the transducers are absorbed by the web portions 50, 50' which bear against vertical walls of the substrate separating the individual ink channels. During the expansion strokes, the upper and lower walls of the ink channel are compressed from above and below, and the reaction forces are likewise transmitted through the web portions 50, 50' and the substrate 18 which are bonded together with sufficient tensile strength, so that the reaction forces cancel each other. Thus, the transducer 40' forms active means for counterbalancing the reaction force of the transducer 40, and vice versa. Even when the pairs of transducers 40, 40' of all nozzle units are energized simultaneously, when a continuous line is being printed, the vertical displacement of the housing parts 48 and 48' is restrained by the web portions 50, 50' intervening between each two adjacent nozzle units. It is therefore not necessary to provide a bulky support structure for the housing parts 48 and 48'. In addition, if the transducer 40 for example exerts a force on the housing part 48, this force is actively compensated by the force which is exerted by the other transducer 40' on the housing part 48' and is transmitted through the web portions 50', 50, and the cross-talk between adjacent nozzle units can largely be eliminated.

This embodiment has a number of remarkable further advantages. Since the forces of the various transducers 40 and 40' are completely balanced at any time, vibrations of the printhead 10 which would be transmitted through the mounting structure thereof are largely suppressed.

Moreover, the effective thickness of the piezoelectric elements is given by the sum of the thicknesses of the transducers 40 and 40', and as a consequence, a desirably high ratio between the effective thickness of the piezoelectric elements and the height of the ink channel 16 can be achieved. On the other hand, the thickness of each transducer 40 or 40' as such is kept small, with the result that only a comparatively small voltage needs to be applied to the electrodes 34, and the manufacture of the piezoelectric transducers is greatly facilitated because of their comparatively small thickness.

For example, the features of the embodiments shown in FIG. 1 and 4 may also be combined with one another by arranging piezoelectric bodies comparable to the piezoelectric body 24 of FIG. 1 symmetrically on both sides of the substrate 18. In this case, the housing parts 48, 48' shown in FIG. 4 may be omitted because the transducers of the odd-numbered nozzle units provide the mechanical coupling between the transducers of the even-numbered nozzle units and vice versa.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. An ink-jet printhead comprising:

a plurality of nozzles and ink channels arranged side by side, each nozzle being connected to an ink reservoir via an associated ink channel;

a plurality of electromechanical transducers, respectively, associated with each ink channel for pressurizing the ink liquid therein for expelling an ink droplet from the nozzle; and active means for compensating for the effect of the reaction force of each transducer by energizing at least one other transducer, wherein a piston-type transducer is associated with each nozzle and said active means comprise at least one auxiliary transducer for each nozzle unit, said auxiliary transducer being mechanically connected to the end of the piston-type transducer remote from the ink channel and being energized to exert on the piston-type transducer a force which is opposite to the reaction force of the same.

2. The ink-jet printhead according to claim 1, wherein the nozzles of one group are offset from the nozzles of the other group in the direction of relative movement of the printhead and the recording medium.

3. The ink-jet printhead according to claim 1, wherein said piston-type transducers and said auxiliary transducers are formed by piezoelectric elements.

4. The ink-jet printhead according to claim 3, wherein each auxiliary transducer is mechanically connected to two adjacent piston-type transducers and is subject to a shear-type deformation when energized.

5. The ink-jet printhead according to claim 4, wherein an energizing electrode to which a variable voltage can be applied, is formed on the end of each piston-type transducer remote from the ink channel, and said energizing electrodes are overlaid by a top layer of piezoelectric material which forms the auxiliary transducers, and wherein the shear-type deformation of the auxiliary transducers is induced by an electric field which is established between the energizing electrodes of neighbouring nozzle units.

6. The ink-jet printhead according to claim 5, wherein the piston-type transducers and the top layer are polarized in opposite directions, such that the portions of the top layer intervening between the auxiliary transducers form secondary piston-type transducers.

7. An ink-jet printhead comprising:

a plurality of nozzles and ink channels arranged side by side, each nozzle being connected to an ink reservoir via an associated ink channel;

a plurality of electromechanical transducers, respectively, associated with each ink channel for pressurizing the ink liquid therein for expelling an ink droplet from the nozzle; and a control member for applying a compensation signal to the transducer of a predetermined nozzle depending on the status of the drop-demand signal applied to at least an adjacent transducer for providing a reaction force of the adjacent transducer, wherein a piston-type transducer is associated with each nozzle and said active means comprise at least one auxiliary transducer for each nozzle unit, said auxiliary transducer being mechanically connected to the end of the piston-type transducer remote from the ink channel and being energized to exert on the piston-type transducer a force which is opposite to the reaction force of the same.

8. The ink-jet printhead according to claim 7, wherein said control means are arranged to supply an energizing signal with a first polarity to a nozzle unit for which a drop-demand signal is present and to supply a compensation signal with an inverse second polarity to those of its neighbours for which no drop-demand signal is present.

9. The ink-jet printhead according to claim 7, wherein said piston-type transducers and said auxiliary transducers are formed by piezoelectric elements.

10. The ink-jet printhead according to claim 9, wherein each auxiliary transducer is mechanically connected to two adjacent piston-type transducers and is subject to a shear-type deformation when energized.

11. The ink-jet printhead according to claim 10, wherein an energizing electrode to which a variable voltage can be applied, is formed on the end of each piston-type transducer remote from the ink channel, and said energizing electrodes are overlaid by a top layer of piezoelectric material which forms the auxiliary transducers, and wherein the shear-type deformation of the auxiliary transducers is induced by an electric field which is established between the energizing electrodes of neighbouring nozzle units.

12. The ink-jet printhead according to claim 11, wherein the piston-type transducers and the top layer are polarized in opposite directions, such that the portions of the top layer intervening between the auxiliary transducers form secondary piston-type transducers.

13. An ink-jet printhead comprising:

a plurality of nozzles and ink channels arranged side by side, each nozzle being connected to an ink reservoir via an associated ink channel;

a plurality of electromechanical transducers, respectively, associated with each ink channel for pressurizing the ink liquid therein for expelling an ink droplet from the nozzle; and active means for compensating for the effect of the reaction force of each transducer by energizing at least one other transducer, wherein said nozzles, ink channels and transducers form a linear array of nozzle units of the drop-on-demand type, and wherein said active means includes a control means for applying a compensation signal to the transducer of a given nozzle unit depending on the status of the drop-demand signals applied to at least its immediate neighbours, wherein the nozzle units are divided into at least two interleaved groups and these groupes are enabled and disabled alternatingly, and wherein when the nozzle units are sequentially numbered as 1, 2, . . . , i, . . . , energizing pulses causing the generation of an ink droplet are supplied to the enabled nozzle units at such timings that the leading edge of a pulse supplied to nozzle unit i coincides with the trailing edge of the pulse supplied to the nozzle unit i-2 (times t2, t5, t8) and compensation pulses are supplied to the disabled nozzle units at such timings that the leading edge of the compensation pulse coincides with the leading edge of the energizing pulse supplied to the nozzle i-2 (times t1, t4, t7) and the trailing edge of the compensation pulse coincides with the trailing edge of the energizing pulse supplied to the nozzle unit i (times t3, t6, t9).

14. The ink-jet printhead according to claim 13, wherein said control means are arranged to supply an energizing signal with a first polarity to a nozzle unit for which a drop-demand signal is present and to supply a compensation signal with an inverse second polarity to those of its neighbours for which no drop-demand signal is present.

15. The ink-jet printhead according to claim 13, wherein the nozzles of one group are offset from the nozzles of the other group in the direction of relative movement of the printhead and the recording medium.

16. An ink-jet printhead comprising:

a plurality of nozzles and ink channels arranged side by side, each nozzle being connected to an ink reservoir via an associated ink channel;

a plurality of electromechanical transducers, respectively, associated with each ink channel for pressurizing the ink liquid therein for expelling an ink droplet from the nozzle; and a control member for applying a compensation signal to the transducer of a predetermined nozzle depending on the status of the drop-demand signal applied to at least an adjacent transducer for providing a reaction force of to the adjacent transducer, wherein the nozzle units are divided into at least two interleaved groups and these groupes are enabled and disabled alternatingly, and wherein when the nozzle units are sequentially numbered as 1, 2, . . . , i, . . . , energizing pulses causing the generation of an ink droplet are supplied to the enabled nozzle units at such timings that the leading edge of a pulse supplied to nozzle unit i coincides with the trailing edge of the pulse supplied to the nozzle unit i-2 (times t2, t5, t8), and compensation pulses are supplied to the disabled nozzle units at such timings that the leading edge of the compensation pulse coincides with the leading edge of the energizing pulse supplied to the nozzle i-2 (times t1, t4, t7) and the trailing edge of the compensation pulse coincides with the trailing edge of the energizing pulse supplied to the nozzle unit i (times t3, t6, t9).

17. The ink-jet printhead according to claim 16, wherein the nozzles of one group are offset from the nozzles of the other group in the direction of relative movement of the printhead and the recording medium.

18. An ink-jet printhead comprising:

a plurality of nozzles and ink channels arranged side by side, each nozzle being connected to an ink reservoir via an associated ink channel;

a plurality of electromechanical transducers, respectively, associated with each ink channel for pressurizing the ink liquid therein for expelling an ink droplet from the nozzle; and active means for compensating for the effect of the reaction force of each transducer by energizing at least one other transducer, wherein the transducers are arranged symmetrically with respect to the plane defined by the ink channels, and said active means for one transducer are formed by its counterpart on the other side of the plane of symmetry and by means for energizing the transducer and its counterpart simultaneously.

19. An ink-jet printhead comprising:

a plurality of nozzles and ink channels arranged side by side, each nozzle being connected to an ink reservoir via an associated ink channel;

a plurality of electromechanical transducers, respectively, associated with each ink channel for pressurizing the ink liquid therein for expelling an ink droplet from the nozzle; and a control member for applying a compensation signal to the transducer of a predetermined nozzle depending on the status of the drop-demand signal applied to at least an adjacent transducer for providing a reaction force of to the adjacent transducer, wherein the transducers are arranged symmetrically with respect to the plane defined by the ink channels, and said active means for one transducer are formed by its counterpart on the other side of the plane of symmetry and by means for energizing the transducer and its counterpart simultaneously.

* * * * *